US007721405B2

(12) United States Patent
Lang et al.

(10) Patent No.: US 7,721,405 B2
(45) Date of Patent: May 25, 2010

(54) JOINING METHOD FOR OPERATING A FASTENING TOOL

(75) Inventors: Hans Jörg Lang, Staudach (DE); Torsten Draht, Schloss Holte (DE)

(73) Assignee: Bollhoff Verbindungstechnik GmbH, Bielefeld (DE)

( * ) Notice: Subject to any disclaimer, the term of this patent is extended or adjusted under 35 U.S.C. 154(b) by 0 days.

(21) Appl. No.: 12/328,667

(22) Filed: Dec. 4, 2008

(65) Prior Publication Data

US 2009/0077786 A1 Mar. 26, 2009

Related U.S. Application Data

(63) Continuation of application No. 11/201,667, filed on Aug. 11, 2005, now Pat. No. 7,475,473.

(30) Foreign Application Priority Data

Sep. 24, 2004 (DE) ..... 10 2004 046 407
Jul. 7, 2005 (DE) ..... 10 2005 031 917

(51) Int. Cl.
*B23P 11/00* (2006.01)

(52) U.S. Cl. ..... 29/505; 29/432

(58) Field of Classification Search ..... 29/505, 29/509, 522.1, 524.1, 525.05, 525.06, 432, 29/432.1, 432.2, 798, 243.5, 243.53, 252; 227/51, 58, 152; 406/279, 280–284
See application file for complete search history.

(56) References Cited

U.S. PATENT DOCUMENTS 5,752,305 A 5/1998 Cotterill et al.
6,041,493 A 3/2000 Donhauser
6,398,096 B1 6/2002 Lang
6,543,115 B1 4/2003 Mauer et al.
6,676,000 B2 1/2004 Lang et al.
6,725,521 B1 4/2004 Blacket et al.
6,742,235 B2 6/2004 Blacket et al.
6,842,962 B1 1/2005 Blacket
7,370,399 B2 * 5/2008 Lang et al. ..... 29/432
7,475,473 B2 * 1/2009 Lang et al. ..... 29/798

FOREIGN PATENT DOCUMENTS

DE 10 130 723 1/2003
DE 10 130 726 1/2003

* cited by examiner

*Primary Examiner*—John C Hong
(74) *Attorney, Agent, or Firm*—Seyfarth Shaw LLP

(57) ABSTRACT

In a method for joining at least two plate-shaped workpieces by a fastening tool and a device for operating the fastening tool, the fastening tool comprises a punch for exerting a punch force to perform a joining operation and a clamp for exerting a clamping force upon the workpieces at the joining area. During the joining operation the punch exerts a high punch force to perform the joining operation and the clamp exerts substantially no clamping force to allow for free material deformation in the joining area. After the joining operation both the punch and the clamp exert high forces at the same time to reduce any material deformations of the workpieces and to provide for compression of the workpieces in the joining area. Preferably the invention is used in a riveting tool for setting self-piercing rivets; as an alternative it may be used in a clinching tool.

31 Claims, 4 Drawing Sheets

JOINING METHOD FOR OPERATING A FASTENING TOOL

CROSS-REFERENCE TO RELATED APPLICATION

This application is a continuation of prior application Ser. No. 11/201,667, filed Aug. 11, 2005, now U.S. Pat. No. 7,475,473 the entirety of which is hereby incorporated by reference.

BACKGROUND OF THE INVENTION

The present invention relates to a method for joining at least two plate-shaped workpieces of similar or different materials by means of a fastening tool, and a device for operating such a fastening tool. Preferably the fastening tool is a riveting tool for setting the self-piercing rivets or a clinching tool for performing a clinching operation.

Various types of drives for fastening tools such as self-piercing riveting and clinching tools have become known. The most common type of drives comprises a hydraulic piston-cylinder-assembly for actuating a punch to perform the joining operation and a further hydraulic piston-cylinder-assembly for actuating a clamp to exert a clamping force upon the workpieces during the joining operation, cf: for example WO93/24256 and EP 0675774. In the method and device of EP 0675774 a "substantial" clamping force is exerted prior to and during the joining operation; as said in this publication the clamping force may be up to 1.5 tons. In practise clamping forces in the order of e.g. 8 to 10 kN are used. Even though this method does have its advantages, exerting a high clamping force prior and during the joining operation does have also some drawbacks. For example the high clamping force exerted during the joining operation may prevent free deformation of the self-piercing rivet. Furthermore, exerting a high clamping force prior to the joining operation may also suffer from some drawbacks in a combined method of using rivets and adhesive to join the workpieces because the high clamping force may detrimentally affect compression and flow of the adhesive from the joining area.

In a prior self riveting apparatus of applicant a small clamping force was exerted by means of a spring during the joining operation, and the clamping force was increased towards the end of the joining operation by having the piston of the hydraulic cylinder of the punch transfer a part of the punch force to the clamp via abutment means. The above mentioned EP 0675774 B1 discloses a similar apparatus wherein before and during the joining operation a separate hydraulic cylinder exerts a "substantial" clamping force which is momentarily increased at the end of the riveting operation to about 5 tons by abutment means between the piston of the punch and the piston of the clamp.

By WO 00/29145 it has become known to withdraw the punch after the joining operation and, when the punch has been withdrawn, to exert a clamping force upon the workpieces so as to reduce deformations of the plate-shaped workpieces (sheets) out of their plane. To this end this document discloses two basic principles for achieving this result. According to one principle a retaining device for the clamp is provided to prevent yielding of the clamp when the lower leg of the C-shaped frame as used in rivet setting machines springs back as a result of the punch having been withdrawn. According to the other principle the punch and the clamp, during the joining operation, are pressurized simultaneously by a high pressure via abutment means, and after the joining operation the punch is withdrawn whereupon the clamp is again pressurized so as to exert a relatively high clamping force. Furthermore, this document mentions that during the joining operation a high or small clamping force or no clamping force at all may be exerted.

Finally, it has become known to exert, prior to the joining operation, at least a small clamping force so as to urge the workpieces against each other and to prevent them from sliding relative to each other and in particular to perform rivet and workpiece checking operations, cf. for example WO 93/24258.

SUMMARY OF THE INVENTION

It is a primary object of the present invention to provide a method for joining at least two plate-shaped workpieces of similar or different materials by a fastening tool and a device for operating such a fastening tool which is of simple structure and operation and compact design.

It is a further object of the present invention to have the joining operation prevented from being detrimentally affected by high clamping forces.

It is a further object of the present invention to provide a method and a device for joining at least two plate-shape workpieces, which method and device are able to obtain a high quality joint and minimal deformation of the workpieces at and round the joining area.

According to the method of the present invention, during the joining operation a high punch force is exerted to perform the joining operation and substantially no clamping force is exerted to enable free material deformation at the joining area, and after the joining operation a high punch force and a high clamping force are exerted at the same time for reducing deformations of the workpieces and to provide for compression of the workpieces at the joining area.

The joining operation is defined as the operation between the beginning and termination of material deformations necessary for making the joint. In the case of self-piercing riveting, the joining operation is the operation between the beginning and termination of the self-piercing rivet penetrating into the workpieces to be joined. In the case of clinching the joining operation is the operation between the beginning and termination of material deformation of the workpieces at the joining area.

The high clamping force exerted after the joining operation is to be selected such that deformations of the workpieces at and around the joining area as caused by the joining operation are reduced and that some compression or compacting effect in the joining area of the workpieces is obtained so as to enhance the quality of the joint and to obtain sufficient final strength of the joint. It is important that, after the joining operation, a high punch force is exerted at the joining area at the same time when the high clamping force is exerted in order to prevent the high clamping force from detrimentally affecting the joint. So the total surfaces at and around the joining area are subjected to high forces after the joining operation whereby the above-mentioned advantages are obtained and furthermore reaction and deflection movements of the C-shaped frame of such fastening tools are reduced. A further advantage of the present invention is that the C-frame may be designed so as to be of reduced weight and strength because substantially no clamping force is exerted during the joining operation so that the C-frame is subjected only to the punch force.

A preferred device of the present invention includes only one hydraulic cylinder which is divided into a piston rod remote work chamber and a piston rod adjacent work chamber by the main piston for the punch. The clamping piston for operating the clamp is disposed in the piston rod work chamber of the hydraulic cylinder, and the sections of the piston rod adjacent work chamber on axially opposite sides of the clamp piston communicate to each other by fluid flow passage means such that the clamping piston can be pressurized on its axially opposite sides by the pressure prevailing in the piston rod adjacent work chamber.

This structural design of the device is suited to perform the method of the invention. To this end the device preferably has an operating position wherein the piston rod remote work chamber is pressurized by a pressure sufficient for performing the joining operation, and the piston rod adjacent work chamber is depressurized; furthermore, the device preferably has a post operating position wherein both work chambers are pressurized by high pressure such that, after the joining operation, a high clamping force and a high punch force are exerted at the joining area at the same time.

Since only one hydraulic cylinder with only two work chambers is required for operating the punch and the clamp, this device of the present invention needs only two fluid pressure ports and only two fluid pressure conduits so that the structural expenditure is minimal. Furthermore, the present invention allows for a compact design of the device because the main piston and the clamping piston are "intercalated". Therefore, in this device of the present invention increasing the stroke of the device by a certain amount will result in the length of the device being increased by a similar amount whereas, in a drive having two separate hydraulic cylinders, increasing the stroke of the device by a certain amount will result in the length of the device being increased by twice the amount.

In another embodiment of the present invention there are provided two hydraulic cylinders. Since however two work chambers of the two cylinders are permanently communicated with each other by flow passage means, many advantages of the first mentioned embodiment will be present also in this second embodiment. For example this second embodiment requires only two pressure ports which again provides for reduced structurable expenditure and a simplified hydraulic control system.

An important advantage of the present invention is that the joining operation is not detrimentally affected by clamping forces. When the invention is used e.g. in a tool for setting self-piercing rivets, the self-piercing rivet is enabled freely to be deformed while penetrating into the workpieces. Deformation of the rivet occurs in a precise manner, and the rivet may be spread more than in a conventional method where high clamping forces are exerted during the riveting operation. Furthermore cracking or fissuring of the rivet is avoided by the present invention.

The method of the present invention may be used in combination with adhesive for joining the workpieces. In such a method, an adhesive layer is provided between the workpieces at and around the joining area before the clamp is urged against the workpieces. Since in the method of the present invention only a small clamping force is exerted prior to the joining operation and substantially no clamping force is exerted during the joining operation, the adhesive may be freely pressed and may freely flow from the joining area during the joining operation. Furthermore, exerting substantially no clamping force during the joining operation results in reduced formation of air bubbles between the workpieces as will be explained in more detail below.

The risk of forming air bubbles between the workpieces may be further reduced by using self-piercing rivets with rivet stems having peripheral surfaces which are tapered, preferably of conical shape. The tapered rivet stem exerts, during the joining operation, a force upon the upper workpiece such that re-bouncing of the upper workpiece is prevented or at least reduced such that the workpieces remain in contact to each other at the joining area. This reduces the risk of formation of air bubbles as will be explained in more detail below.

As already mentioned, the present invention allows to avoid or at least reduce reactive movements or deflections of the C-frame whereby the joining quality and final strength of the joint are enhanced.

BRIEF DESCRIPTION OF THE DRAWINGS

With reference to the drawings preferred embodiments of the present invention will be described in detail. In the drawings.

DETAILED DESCRIPTION OF THE PREFERRED EMBODIMENTS

Figure 1:
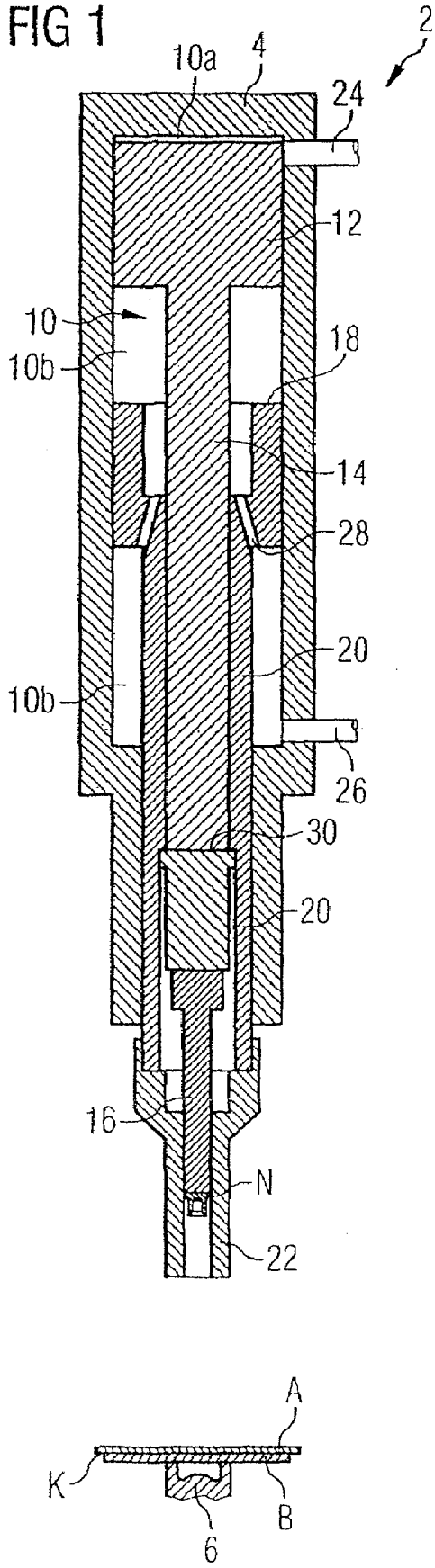
FIG. 1 is a longitudinal section of a fastening tool of the present invention in a basic position.
Figure 2:
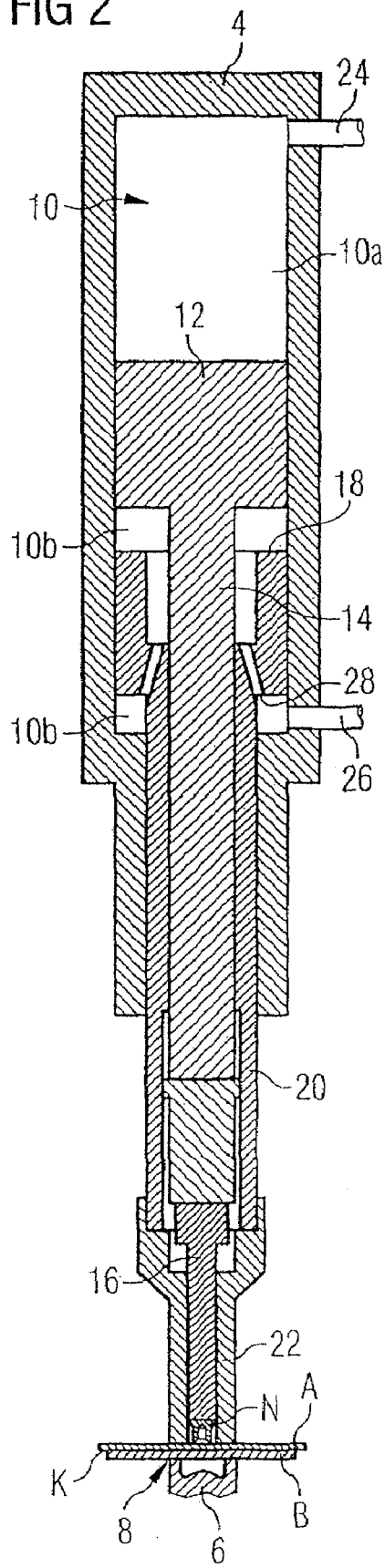
FIG. 2 is a longitudinal section similar to FIG. 1 of the fastening tool in a pre-operating position.
Figure 3:
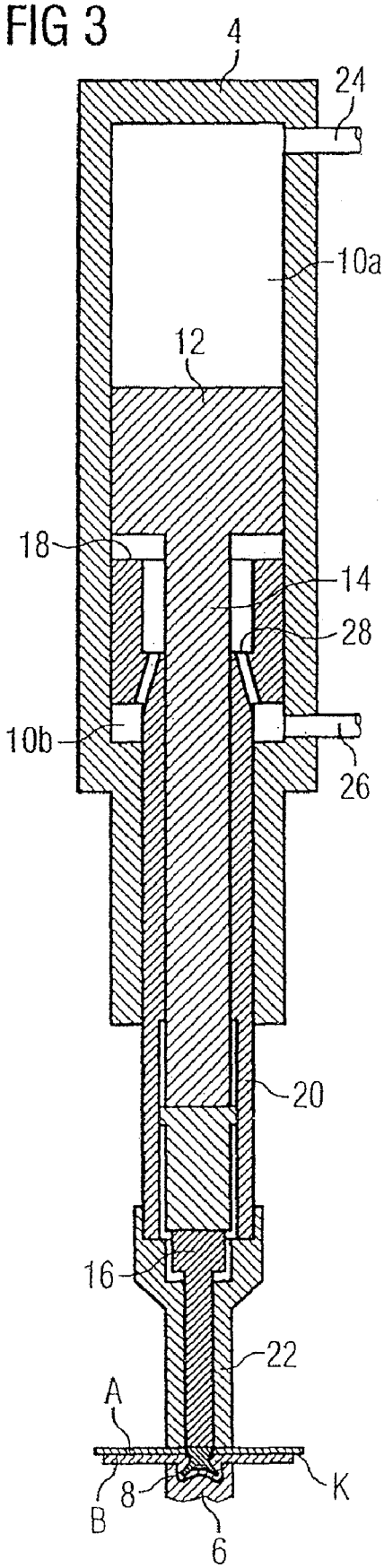
FIG. 3 is a longitudinal section similar to FIG. 1 of the fastening tool in an operating position and post-operating position.

The fastening tool 2 shown only schematically in the FIGS. 1 to 3 is arranged to make a joint between two (or more) plate-shaped workpieces A and B (metal sheets). In the embodiment as shown the fastening tool 2 is a rivet setting device for setting self-piercing rivets N even though the fastening tool 2 could be another tool such as for example a clinching device. Since self-piercing rivets and self-piercing rivet joints are basically known, they will not be described any further.

The fastening tool 2 includes a drive comprising a hydraulic cylinder 4, and a die 6, with the workpieces A, B being supported thereagainst. The cylinder 4 is supported on a C-shaped frame (not shown) as is usual in fastening tools of this type.

The hydraulic cylinder 4 has a cylindrical cavity 10 receiving a main piston 12 with a piston rod 14 so as to be displaceable therein. The piston rod 14 of the main piston 12 is integrally connected to a punch 16 for setting the rivet N.

As is shown in FIGS. 1 to 3, the main piston 4 divides the cylindrical cavity 10 into a piston rod remote upper work chamber 10*a* and a piston rod adjacent lower work chamber 10*b*. The lower work chamber 10*b* receives a clamping piston 18 which is integrally connected to a sleeve-shaped clamp 22 (clamping nose) via a piston rod 20. The clamping piston 18 and its piston rod 20 coaxially surround the piston rod 14 of the main piston 12 and are slidingly guided along the cylindrical inner wall of the cylinder 4 such that they are axially displaceable relative to the main piston 12.

The upper work chamber 10*a* has a fluid pressure port 24 for selectively being pressurized by a controlled fluid pressure (hydraulic pressure) or depressurized, while the lower work chamber 10*b* has its own fluid pressure port 26 for selectively being pressurized by a controlled fluid pressure or being depressurized. As schematically shown in the figures, the sections of the work chamber 10*b* on opposite sides of the clamping piston 18 communicate with each other via fluid flow passage means 28 such that the axially opposite sides of the clamping piston 18 are always pressurized by the same fluid pressure. The fluid flow passage means 28 may comprise one or several bores through the clamping piston 18 or may be provided otherwise, for example by one or several longitudinal grooves at the outer periphery of the clamping piston 18.

Furthermore, between the piston rod 14 of the main piston 12 and the sleeve-shaped piston rod 20 of the clamping piston 18 there is provided an abutment means 30 which acts only in one axial direction, i.e. when the main piston 12 moves in a direction away from the lower work chamber 10*b* (upwards in the figures).

Operation of the device described above is as follows:

In FIG. 1 the device is in its basic position wherein the upper work chamber 10*a* is depressurized via the fluid pressure port 24 and the lower work chamber 10*b* is pressurized by a relatively small fluid pressure via its fluid pressure port 26. The fluid pressure prevailing in the lower work chamber 10*b* urges the main piston 12 to its upper end position. The fluid pressure prevailing in the lower work chamber 10*b* acts upon the axially opposite sides of the clamping piston 18. Since the upper surface area of the clamping piston 18 exceeds its lower surface area for an amount similar to the cross-sectional surface area of the piston rod 20, a downwardly directed pressure difference acts upon the clamping piston 18. However, the abutment means 30 between the two piston rods 14 and 20 retains the clamping piston 18 in its basic position which is an axially intermediate position as shown in FIG. 1.

The operation for setting the self-piercing rivet N and therefore for making the joint is performed in three steps:

In a first step, prior to the joining operation, the main piston 12 and the clamping piston 18 are moved to a pre-operating position wherein the clamp 20 and the rivet N are urged against the workpieces A and B by a relatively small force, see FIG. 2. To this end both work chambers 10*a*, 10*b* are each pressurized by a small fluid pressure via its respective fluid pressure port 24 and, respectively, 26. Since the upper surface area of the main piston 12 exceeds its lower surface area for an amount similar to the cross-sectional surface area of the piston rod 14, the punch 18 exerts a corresponding downwardly directed punch force upon the rivet N at a joining area 8 including the rivet N and the workpiece area between the clamp 22 and the die 6. Also the clamping piston 18 is urged downwards by the fluid pressure due to the mentioned surface difference so that the clamp 20 exerts a corresponding clamping force upon the workpieces A, B adjacent and around the rivet N at the joining area 8. The punch force and the clamping force need to be only of a size sufficient to prevent movements of the workpieces A, B relative to each other and relative to die 6 and to allow for performing rivet and workpiece checking operations. The clamping force is preferably less than 7.8 kN and may be for example in the order of 3 to 5 kN. Generally a clamping force of less than 3.9 kN is sufficient. The punch force is preferably less than 5 kN and may be in the order of 1 to 3 kN.

In a second step), the joining operation proper, the device is in the operating position shown in FIG. 3, wherein the upper work chamber 10*a* is pressurized by the fluid pressure necessary for the joining operation via the fluid pressure port 24, while the lower work chamber 10*b* is depressurized via its fluid pressure port 26. The main piston 12 exerts, via the piston rod 14 and the punch 16, a punch force upon the rivet N, at the joining area 8 the punch force being of a value sufficient for making the joint, see FIG. 3. Since the lower work chamber 10*b* is depressurized, the clamp 20 does not perform any function during the joining operation. It goes without saying that in hydraulic systems there is always a residual pressure at the low pressure side such that the lower workchamber cannot be depressurized so as to be completely pressureless. However, the resulting clamping force which may be in the order of 0.3 to 0.5 kN, is negligible. Depending on the material of the workpieces as used, a clamping force of e.g. less than 4 kN has not any measurable influence on the workpiece properties. In any case this is true for clamping forces of less than 1.5 kN.

As mentioned above, the lack of significant clamping forces enables the rivet N to be freely deformed into the workpieces A, B and the die 6 during the setting operation so that deformation of the rivet occurs in a precisely defined manner. As compared to conventional methods using high clamping forces, a somewhat increased bottom of the rivet N will result so as to avoid the risk of cracking or fissuring thereof.

The punch force needed for setting the self-piercing rivet N is in the usual order of e.g. 30 to 80 kN.

In a third step following the joining operation when the device is in a post-operating position also shown in FIG. 3, both work chambers 10*a* and 10*b* are pressurized by high fluid pressures via their fluid pressure ports 24 and 26. Preferably, this is performed by maintaining the high fluid pressure prevailing in work chamber 10*a* while work chamber 10*b* is pressurized by the same fluid pressure or a similar high fluid pressure via fluid pressure port 26.

To ensure that deformation of the self-piercing rivet during the joining operation is continued to its end without any disturbances, pressurisation of work chamber 10*b* and, accordingly, increase of the clamping force are initiated only a brief duration after termination of the joining operation. This duration is for example 0.2 to 0.3 seconds and preferably exceeds 0.1 seconds.

Pressurization of work chambers 10*a* and 10*b* as described will result in the punch 6 being urged against rivet N by a high punch force due to the above mentioned surface difference of the main piston 12. At the same time the clamp 20 exerts a high clamping force upon the workpieces A, B due to the above mentioned surface difference of the clamping piston 18. The high clamping force is intended to reduce potential deformations of the workpieces A, B at the joining area 8 from their planes and furthermore to perform some compacting action upon the workpieces A, B in this area so as to enhance final strength and quality of the joint. Furthermore, since not only the clamp 20 but also the punch 16 exerts a high force upon the joint, a certain equalizing effect with respect to the forces acting at the joining area will be obtained. Finally, the punch force and the clamping force prevent or at least reduce reactive movements or re-bouncing of the C-shaped frame (not shown).

The punch force and the clamping force are to be selected to obtain these functions depending on the specific application. Preferably, the clamping force exceeds 5 kN and in particular 7.8 kN. The punch force preferably exceeds 5 kN and in particular 6.5 kN.

The punch force and the clamping force are maintained during a predetermined duration. Thereafter the device is returned to its basic position shown in FIG. 1 by depressurizing the upper work chamber 10*a* via its fluid pressure port 24 and by pressurizing the lower work chamber 10*b* by low fluid pressure via its fluid pressure port 26.

Figure 4:
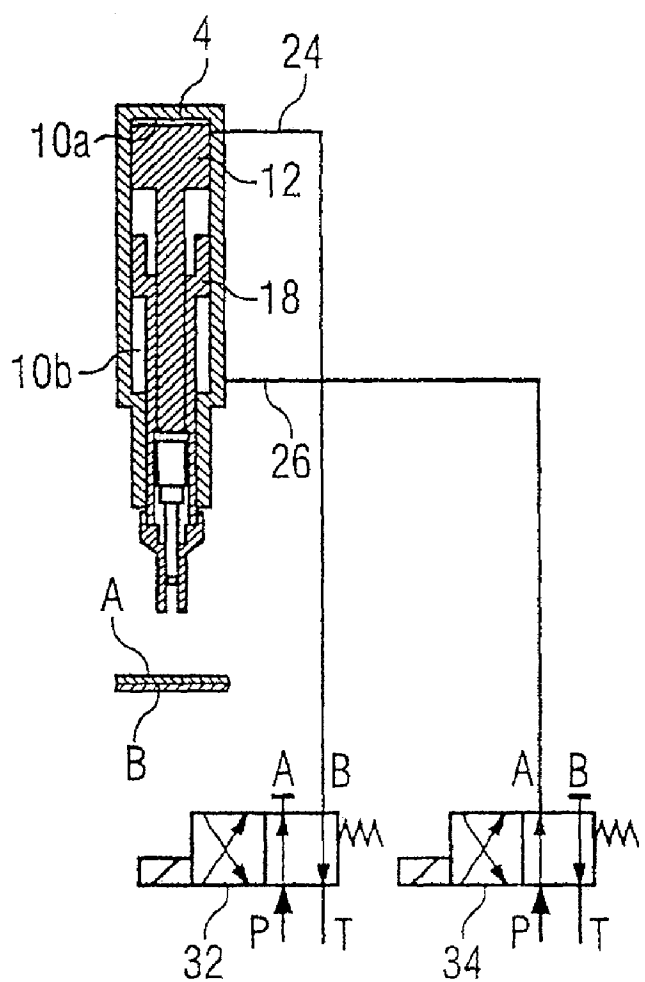
FIG. 4 is a longitudinal section of the fastening tool of FIGS. 1 to 3 including a valve assembly for hydraulic control of the fastening tool in its basic position.

FIG. 4 schematically shows a fastening tool 2 as described above with reference to FIG. 1 to 3 in connection with a valve-assembly of a (not shown) hydraulic control system for operating the fastening tool. The valve-assembly consists of a pair of separate directional valves 32 and 34 of which the directional valve 32 communicates with the work chamber 10*a* via the fluid pressure port 24 and the directional valve 34 communicates with the work chamber 10*b* via the fluid pressure port 26 in order to pressurize and depressurize the work chambers 10*a* and 10*b*. Accordingly, the directional valves 32 and 34 control communications between each of the work chambers 10*a*, 10*b* and a (not shown) pressure control device (e.g. a proportional valve) and a low pressure area of the hydraulic control system.

Figure 5:
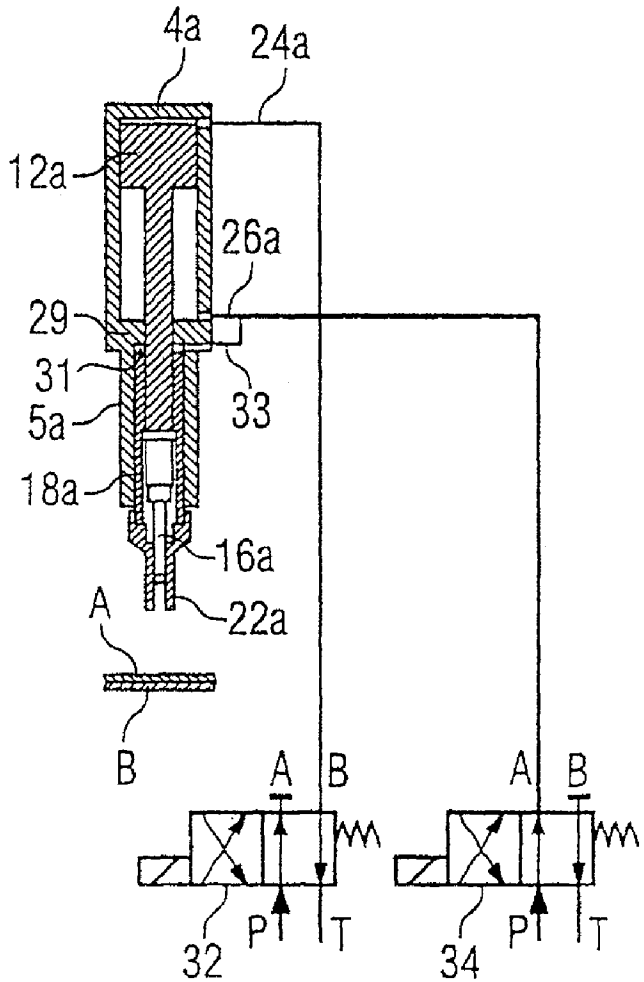
FIGS. 5 to 8 are representations similar to FIG. 4 of modified embodiments of the fastening tool and the valve assembly.

Operation of the hydraulic control system is similar to the operation as described above with reference to FIGS. 1 to 3. Additionally the following is to be noted:

In the basic position of the device as shown in FIG. 5, the directional valve 32 is in a pressure relief position, and the directional valve 34 is in a pressurization position. When the joining tool is in the pre-operating position, the directional valves 32, 34 are in their pressurization positions, wherein both work chambers 10*a*, 10*b* are pressurized by low fluid pressure. When the joining tool is in its operating or joining position, the directional valve 32 is in its pressurization position, and the directional valve 34 is in its pressure relief position in order to have the punch exert a high punch force and, respectively, have the clamp exert substantially no clamping force. When the joining tool is in its operating position, both directional valves 32, 34 are in their pressurization positions in order to have both the punch and the clamp exert high forces.

The embodiment shown in FIG. 5 differs from that of FIG. 4 with regard to the structure of the cylinder assembly of the joining tool. Components similar to those in FIG. 4 are designated by the same reference numerals with the addition of the letter a. The joining tool of FIG. 5 differs from that of FIG. 4 by the fact that instead of a common hydraulic cylinder 4, there are provided two cylinders 4*a* and 5*a* of which the cylinder 4*a* receives the main piston 12*a* for the punch 16*a* and the cylinder 5*a* receives the clamp piston 18*a* for the clamp 22*a* A partition 29 between the cylinders 4*a* and 4*b* together with the clamp piston 18*a* define a work chamber 31 which has its own fluid pressure port in the embodiment as shown.

As described so far this assembly is similar to conventional self-piercing riveting tools having separate cylinders for the punch and clamp. In contrast to these conventional self-piercing riveting tools, the embodiment of FIG. 5 is of a design such that the piston rod adjacent work chamber of the cylinder 4*a* and the work chamber 31 of the cylinder 5*a* are permanently in communication with each other by a fluid flow passage 33. The fluid flow passage 33 may extend, as shown, externally of the cylinder or through the partition 29.

As a result of the permanent communication between the piston rod adjacent work chamber of the cylinder 4*a* and the work chamber 31 of the cylinder 5*a* operation of the assembly in FIG. 5 is similar of that of the assembly in FIG. 4. So also in the assembly of FIG. 5 two simple directional valves 32 and 34 are sufficient to control pressurization and pressure relief of the individual work chambers. Therefore, as to operation of the assembly of FIG. 5 attention is drawn to the description of the operation of the assembly in FIG. 4.

Figure 6:
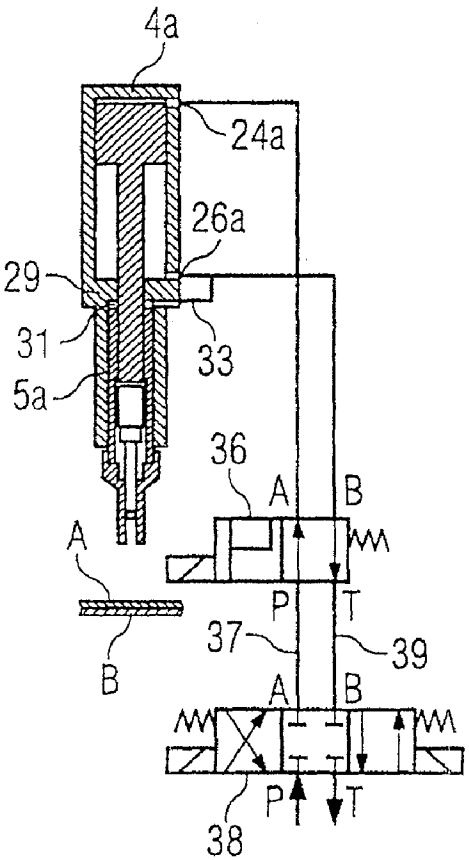

Referring to FIG. 6, the structure of the joining tool including the hydraulic cylinders 4*a* and 5*a* shown therein is identical to that of FIG. 5. FIGS. 5 and 6 differ from each other only in that, there are provided a bypass valve 36 and a directional valve 38 connected in series, instead of the directional valves 32 and 34 connected in parallel.

The directional valve 38 is displaceable between a basic position (shown in FIG. 6) and an operative position. When the directional valve 38 is in its basic position, it isolates a pair of pressure fluid lines 37, 39 from the pressure source and the low pressure area of the hydraulic system. When the directional valve 38 is in its operative position, it communicates the pressure fluid line 37 with the pressure source and the pressure fluid line 39 with the low pressure area.

The bypass valve 36 is displaceable between a basic position (shown in FIG. 6) and a bypass position. When the bypass valve 36 is in its basic position, it communicates the fluid pressure line 37 with the fluid pressure port 24*a*, and the fluid pressure line 39 with the fluid pressure port 26*a*. When the bypass valve 36 is in its bypass position, it communicates both pressure ports 24*a*, 26*a* with the fluid pressure line 37.

Operation is as follows:

In FIG. 6 the bypass valve 36 and the directional valve 38 are in their basic positions. To set the joining tool into its pre-operating position, the directional valve 36 is displaced into its operative position where it remains when the joining tool will be in its operating and post-operating positions.

When the joining tool is in its pre-operating position, the bypass valve 36 is in its bypass position wherein it communicates the piston rod remote and piston rod adjacent work chambers of the cylinder 4*a* and the work chamber 31 of the cylinder 5*a* with the (controllable) pressure source of the hydraulic system via the fluid pressure line 37 and the directional valve 38. To move the joining tool to its operating position, the bypass valve 36 is returned to its basic position where it communicates the piston rod remote work chamber of the cylinder 4*a* with the pressure source, and the piston rod adjacent work chamber and the work chamber 31 with the low pressure side of the hydraulic system. When the joining tool is in its post-operating position, the bypass valve 36 will be again in its bypass position wherein all work chambers are communicated with the pressure source.

It is to be noted that the valve assembly of FIG. 6 can be used also in a joining tool as shown in FIG. 4.

Figure 7:
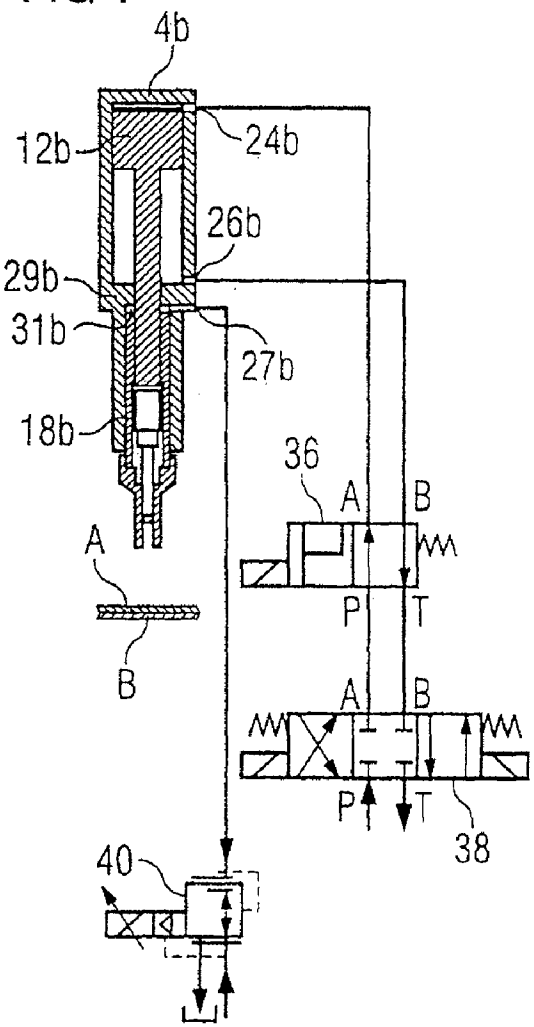

The joining tool shown in FIG. 7 is of a structure which is essentially similar to that shown in FIG. 6. Corresponding components have been designated by similar reference numerals wherein the letter a has been replaced by the letter b. A difference with respect to FIG. 6 is that the fluid flow passage 33 has been omitted. Rather the work chamber 31*b* of the cylinder 5*b* has a pressure fluid port 27*b* separate from the pressure fluid port 24*b*, 26*b*; the fluid pressure port 27*b* may be pressurized and depressurized via a pressure control valve 40 (e.g. a proportional valve). The joining tool including the two cylinders 4*b* and 5*b* for actuating the punch and the clamp, therefore, is similar to that of a conventional joining tool.

The fluid pressure ports 24*b* and 26*b* of the work chambers of the cylinder 4*b* are adapted to be controlled via a bypass valve 36 and a directional valve 38 which are identical to the respective valves in FIG. 6.

FIG. 7 shows the valves in their basic positions. As to actuation of the bypass valve 36 and the directional valve 38 prior to, during and after the joining operation, reference is made to the description of FIG. 6. The pressure control valve 40 is operated such that the work chamber 31*b* is pressurized by a relatively low pressure in the pre-operating position, by a negligible pressure in the operating position, and by a high pressure in the post-operating position of the joining tool.

The arrangement of FIG. 7 enables the piston rod adjacent work chamber of the cylinder 4*b* to be depressurized via the bypass valve 36 in the post-operating position so that the punch force exerted by the main piston 12*b* can be increased correspondingly.

Figure 8:
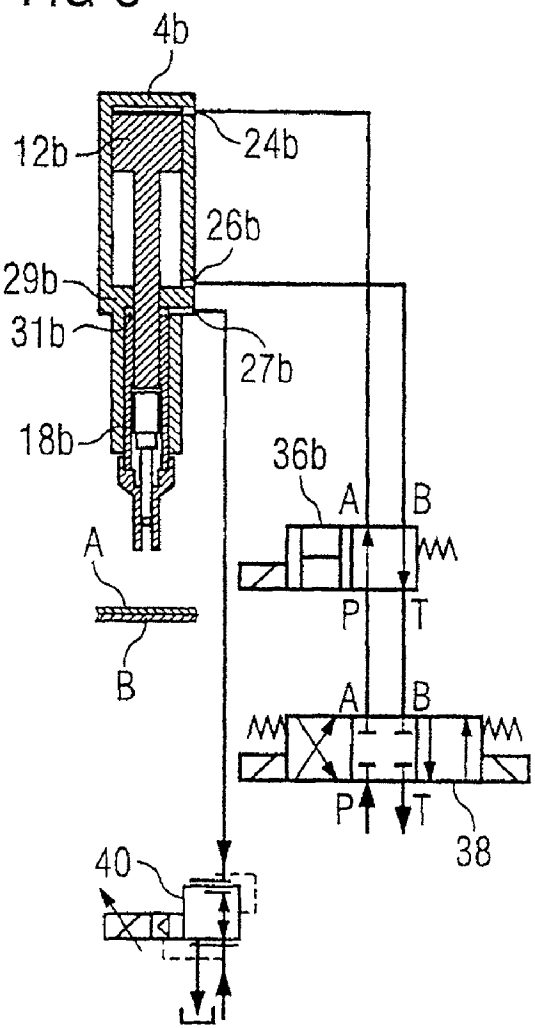

The arrangement shown in FIG. 8 differs from that in FIG. 7 only in that the bypass valve 36 of FIG. 7 has been replaced by a bypass valve 36*b* which when in the bypass position communicates the piston rod remote work chamber and piston rod adjacent work chamber of the cylinder 4, however, isolates them with respect to the pressure source of the hydraulic system. When the joining tool is in the pre-operating position, both work chambers of the cylinder 4*b* are pressureless so that the punch does not exert any punch force. Therefore, this embodiment does not allow for rivet detection when the joining tool is in its pre-operating position. In all other embodiments of the invention, when the joining tool is in the pre-operating position the punch exerts a punch force which can be used for rivet detection. Apart therefrom, operation of the arrangement of FIG. 6 is similar to that of the arrangement in FIG. 7.

In the embodiments of FIGS. 1 to 7 the first working step prior to the joining operation can be performed in two stages such that initially the clamp is actuated to exert the required relatively small clamping force and thereafter the rivet is urged against the workpieces by the punch by a relatively small punch force. This allows to depressurize the clamp already a brief duration prior to setting the rivet because the workpieces are held in contact to each other by the rivet.

As mentioned above the riveting method of the present invention can be combined with a method using adhesive between adjacent surfaces of the workpieces at least at the joining area. More particularly, to this end an adhesive layer K is provided between the workpieces A and B, cf. FIGS. 1 to 3.

In a conventional riveting method as disclosed e.g. in EP 0675774 wherein a high clamping force is exerted prior to and during the joining operation, the adhesive is enclosed within the central joining area by the clamping pressure before the joining operation. As a result free compression and flow of the adhesive from the joining area radially outwards is not possible during the joining operation. On the other hand, a high clamping force enhances re-bouncing of the upper workpiece when it has been penetrated by the self-piercing rivet. This may result to formation of air bubbles and channels within the adhesive layer.

In contrast thereto, in the method of the present invention where before the joining operation only a relatively small clamping force is exerted and during the joining operation substantially no clamping force is exerted, the adhesive may be freely compressed and may freely flow from the joining area radially outwards during the joining operation. Furthermore, exerting substantially no clamping force during the joining operation will reduce re-bouncing of the upper workpiece A which also reduces the risk of air bubbles and channels within the adhesive layer K.

Figure 9:
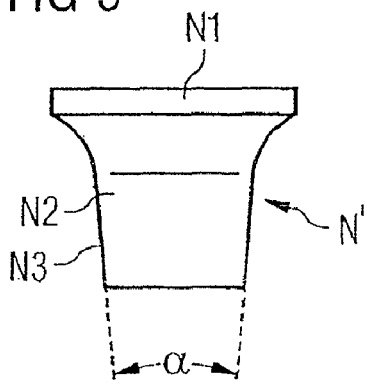
FIG. 9 is a special self-piercing rivet to be used in the method and device of the present invention.

In order further to reduce this risk, self-piercing rivets N' as shown in FIG. 9 are used along with adhesive in the combined method. The self-piercing rivet N' comprises, a rivet head N1 and a rivet stem N2. In contrast to conventional rivets, the peripheral surface N3 of the rivet stem N2 is not cylindrical but slightly tapered so as to be divergent towards the rivet head N1. More precisely, the peripheral surface N3 is of conical shape having a cone angle $\alpha$. Therefore, when the rivet N' with its conical peripheral surface N3 is driven so as to penetrate into the workpieces A, B (FIG. 3), the rivet stem N2, due to its tapered peripheral surface, exerts upon the upper workpiece A a downward force which prevents the upper workpiece A from re-bouncing, i.e. from being deflected upwards. As a result the workpieces A, B remain in contact to each other in the joining area so as to avoid any gap between the workpieces A, B and to prevent the formation of air bubbles and channels within the adhesive layer K.

The cone angle $\alpha$ exceeds 0 in each case and is preferably in the range between 0.5 to 10°, in particular in the range from 1 to 5°. As shown, the peripheral surface of the rivet stem N2 may be tapered along its total length. As an alternative, only a certain portion of the peripheral surface could be tapered while the remaining portion of the peripheral surface would be cylindrical. In particular, it would be possible to make the peripheral surface N3 in a bottom portion cylindrical while only the portion between the bottom portion and the head N1 would be tapered. The axial length of this bottom portion preferably would be selected such that it does not exceed the thickness of the upper workpiece A.

The use of such self-piercing rivets N' in a combined rivet-adhesive-method for joining workpieces is particularly effective in avoiding any gaps between the workpieces A, B in the joining area and in preventing the formation of air bubbles and channels within the adhesive layer K.

What is claimed is:

1. A method for joining at least two plate-shaped workpieces of similar or different materials by means of a fastening tool including a punch for exerting punch forces to perform a joining operation at a joining area and including a clamp for exerting clamping forces upon said workpieces supported against a die, the method comprising the steps of:

during the joining operation, exerting a first punch force to perform the joining operation;

throughout the joining operation, limiting a first clamping force from the clamp at the joining area, wherein the first clamping force permits free material deformation at the joining area;

after the joining operation, exerting a second clamping force; and after the joining operation, exerting a second punch force, wherein the second punch force and the second clamping force are exerted at the same time to reduce deformations of the workpieces and to provide for compression of the workpieces at the joining area.

2. The method of claim 1 further including the step of maintaining the second clamping force and the second punch force for a predetermined duration.

3. The method of claim 1 wherein the step of exerting the second clamping force includes initiating the second clamping force a short time after termination of the joining operation.

4. The method of claim 1 wherein the step of exerting the second clamping force includes exerting a force of at least 5 kN.

5. The method of claim 1 wherein the step of exerting the second clamping force includes exerting a force of approximately 7.8 kN.

6. The method of claim 1 further including the step of, prior to the joining operation, urging the clamp against the workpieces to prevent relative displacement of the workpieces with respect to each other, the step of urging the clamp including exerting a third clamping force.

7. The method of claim 1 further including the step of, prior to the joining operation, exerting a third punch force to perform a checking operation at the joining area.

8. The method of claim 7 wherein the step of exerting the third punch force includes exerting a force less than 5.0 kN.

9. The method of claim 8 wherein the step of exerting the third punch force includes exerting a force less than 2.5 kN.

10. The method of claim 1 wherein the step of exerting the second punch force includes exerting a force of approximately 6.5 kN.

11. The method of claim 1 wherein the step of limiting the first clamping force includes preventing the first clamping force from exceeding 4 kN.

12. The method of claim 1 wherein the step of limiting the first clamping force includes preventing the first clamping force from exceeding 1.5 kN.

13. A method of using a fastening tool for joining at a joining area at least two plate-shaped workpieces of similar or different materials, the fastening tool including a punch for exerting punch force and a clamp for exerting clamping force upon said workpieces supported against a die, the steps of the method comprising:

exerting a first clamping force with the clamp, the first clamping force sufficient to restrict relative movement between the workpieces;

exerting a first punch force with the punch to perform the joining operation;

throughout the joining operation, limiting a second clamping force from the clamp at the joining area, wherein the second clamping force permits free material deformation at the joining area; and exerting a third clamping force and a second punch force after the joining operation to reduce deformations of the workpieces and to provide for compression of the workpieces at the joining area.

14. The method of claim 13 further including the step of reducing the force exerted by the clamp at the beginning of the joining operation, the second clamping force being less than the first clamping force.

15. The method of claim 14 wherein the step of limiting the second clamping force includes permitting substantially no clamping force.

16. The method of claim 14 wherein the step of reducing the force exerted by the clamp includes depressurizing a workchamber for the clamp.

17. The method of claim 14 wherein the first clamping force is between 1 and 7.8 kN.

18. The method of claim 17 wherein the first clamping force is approximately 3.9 kN.

19. The method of claim 14 wherein the second clamping force is below 4 kN.

20. The method of claim 19 wherein the second clamping force is below 1.5 kN.

21. The method of claim 13 wherein the first punch force is sufficient for setting a self-piercing rivet in the workpieces.

22. The method of claim 13 wherein the first punch force is between approximately 30 and 80 kN.

23. The method of claim 13 wherein the third clamping force and second punch force are greater than 5 kN.

24. The method of claim 13 wherein the third clamping force is approximately 7.8 kN.

25. The method of claim 13 wherein the second punch force is approximately 6.5 kN.

26. A method for joining at least two plate-shaped workpieces of similar or different materials by means of a fastening tool which comprises a punch for exerting a punch force to perform a joining operation at a joining area and a clamp for exerting a clamping force upon said workpieces supported against a die, in which method:

during the joining operation a first punch force between approximately 30 to 80 kN is exerted to perform the joining operation and substantially no clamping force is exerted to enable free material deformation at the joining area, a first clamping force greater than approximately 5 kN is exerted only after the joining operation, and a second punch force greater than approximately 5 kN and the first clamping force are exerted at the same time after the joining operation to reduce deformations of the workpieces and to provide for compression of the workpieces at the joining area.

27. The method of claim 26 wherein said first clamping force is approximately 7.8 kN.

28. The method of claim 26 wherein the second punch force is approximately 6.5 kN.

29. The method of claim 26 further including the step of, prior to the joining operation, exerting a second clamping force less than 3.9 kN against the workpieces by the clamp to prevent relative displacement of the workpieces with respect to each other.

30. The method of claim 26 further including the step of, prior to the joining operation, exerting a third punch force less than 5.0 kN to perform a checking operation at the joining area.

31. The method of claim 30 wherein said third punch force is less than 2.5 kN.

* * * * *